US010064464B1

(12) United States Patent
Birnbaum

(10) Patent No.: US 10,064,464 B1
(45) Date of Patent: Sep. 4, 2018

(54) SHOE WITH RETRACTABLE SPIKE MECHANISM FOR CANES AND CRUTCHES

(71) Applicant: Bernardo Birnbaum, Aventura, FL (US)

(72) Inventor: Bernardo Birnbaum, Aventura, FL (US)

( * ) Notice: Subject to any disclaimer, the term of this patent is extended or adjusted under 35 U.S.C. 154(b) by 0 days.

(21) Appl. No.: 15/596,856

(22) Filed: May 16, 2017

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A61H 2003/0211* (2013.01)

(58) Field of Classification Search
CPC . A61H 3/0288; A61H 2003/0222; A45B 9/04
See application file for complete search history.

(56) References Cited

U.S. PATENT DOCUMENTS 616,738 A * 12/1898 Schwarting ..... A45B 9/04 135/78
2,606,568 A * 8/1952 Walcot ..... A61H 3/0288 135/80
3,376,880 A * 4/1968 Stark ..... A45B 9/04 135/81
3,448,749 A * 6/1969 Stark ..... A45B 9/04 135/70
3,949,773 A * 4/1976 Marescalco ..... A45B 9/04 135/78
4,411,284 A * 10/1983 Opitz ..... A45B 9/04 135/81
5,056,546 A * 10/1991 Sharp ..... A61H 3/0288 135/68
5,845,664 A * 12/1998 Ryder ..... A45B 3/04 135/65
9,414,656 B1 * 8/2016 Greene ..... A45B 9/04
2013/0092201 A1 * 4/2013 Barbone ..... A45B 3/00 135/66
2013/0276845 A1 * 10/2013 Moulton ..... A45B 9/04 135/72
2014/0251398 A1 * 9/2014 Moulton, III ..... A61H 3/0288 135/77

* cited by examiner

*Primary Examiner* — David R Dunn
*Assistant Examiner* — Danielle Jackson
(74) *Attorney, Agent, or Firm* — Sanchelima & Associates, P.A.; Jesus Sanchelima; Christian Sanchelima

(57) ABSTRACT

A shoe for canes and crutches composing a cylindrical tubular member having an end mounted to the end of a shaft or crutch, and the other end having a central bore axially extending inwardly a defining a first bottom and coaxially disposed second bore having a smaller diameter than said first bore and extending a second predetermined distance defining a second bottom. A circular plate with a central through opening biased by a coil spring member coaxially disposed around a post. A cap member is sandwiched between a knob connected to the plate for rotating the latter and causing it to move along the post to engage the irregular through opening to a cutout in the post.

1 Claim, 11 Drawing Sheets

SHOE WITH RETRACTABLE SPIKE MECHANISM FOR CANES AND CRUTCHES

BACKGROUND OF THE INVENTION

1. Field of the Invention

The present invention relates to a shoe with retractable spike mechanism for canes and crutches

2. Description of the Related Art

Several designs for shoes for canes and crutches have been designed in the past. None of them, however, include a retractable spike mechanism that does not protrude outwardly, is reliable and easy to deploy and retract.

SUMMARY OF THE INVENTION

It is one of the main objects of the present invention to provide a retractable spike mechanism 40 for canes and crutches that is self-contained and does not protrude outwardly from the cane or crutch end that houses it.

It is another object of this invention to provide a spike mechanism 40 that can be readily deployed and retracted.

It is still another object of the present invention to provide a reliable spike mechanism 40 for canes and crutches.

It is yet another object of this invention to provide such a spike mechanism 40 that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
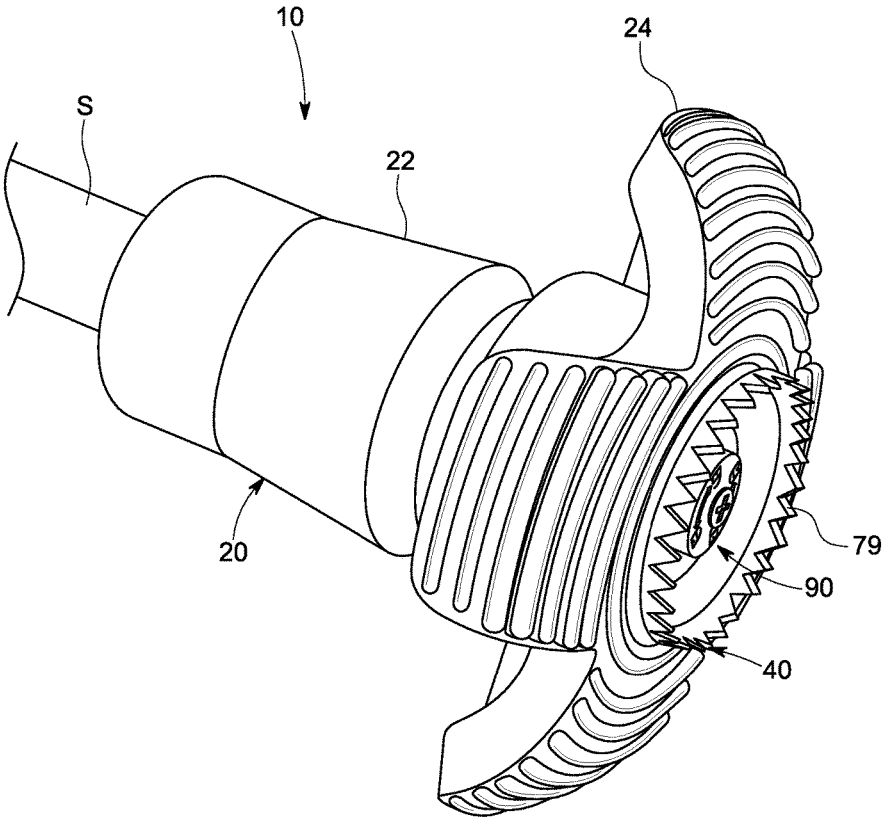
FIG. 1 represents an isometric view of the shoe with the spike mechanism 40 deployed.

Referring now to the drawings, where the present invention is generally referred to with numeral 10, it can be observed that it basically includes a cylindrical tubular assembly 20, and spike mechanism 40 housed therein. Spike mechanism 40 includes slotted locking plate 30, coil spring member 65, teethed cap member 70, knob assembly 80 and stopper screw assembly 90.

Figure 1A:
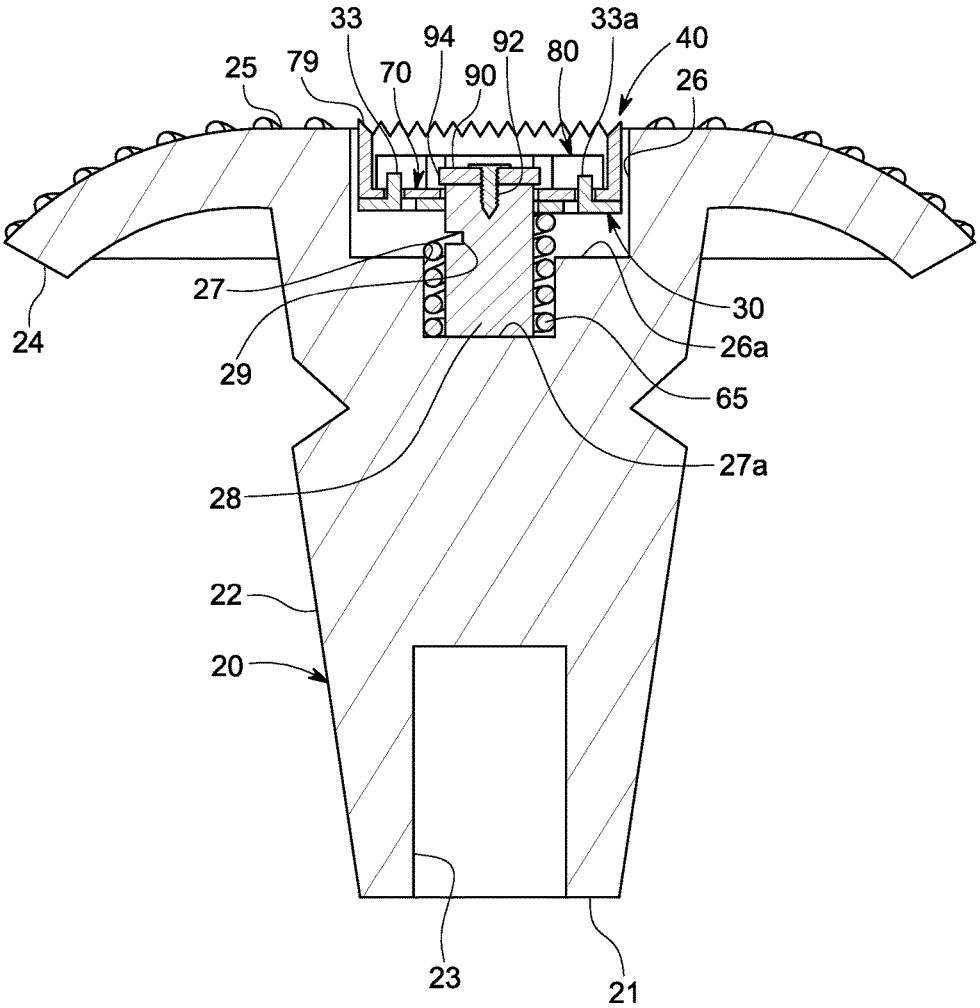
FIG. 1A is a cross-sectional view of shoe 10 with spike mechanism 40 deployed with slotted locking plate 30 disengaged from cutout 29.
Figure 1B:
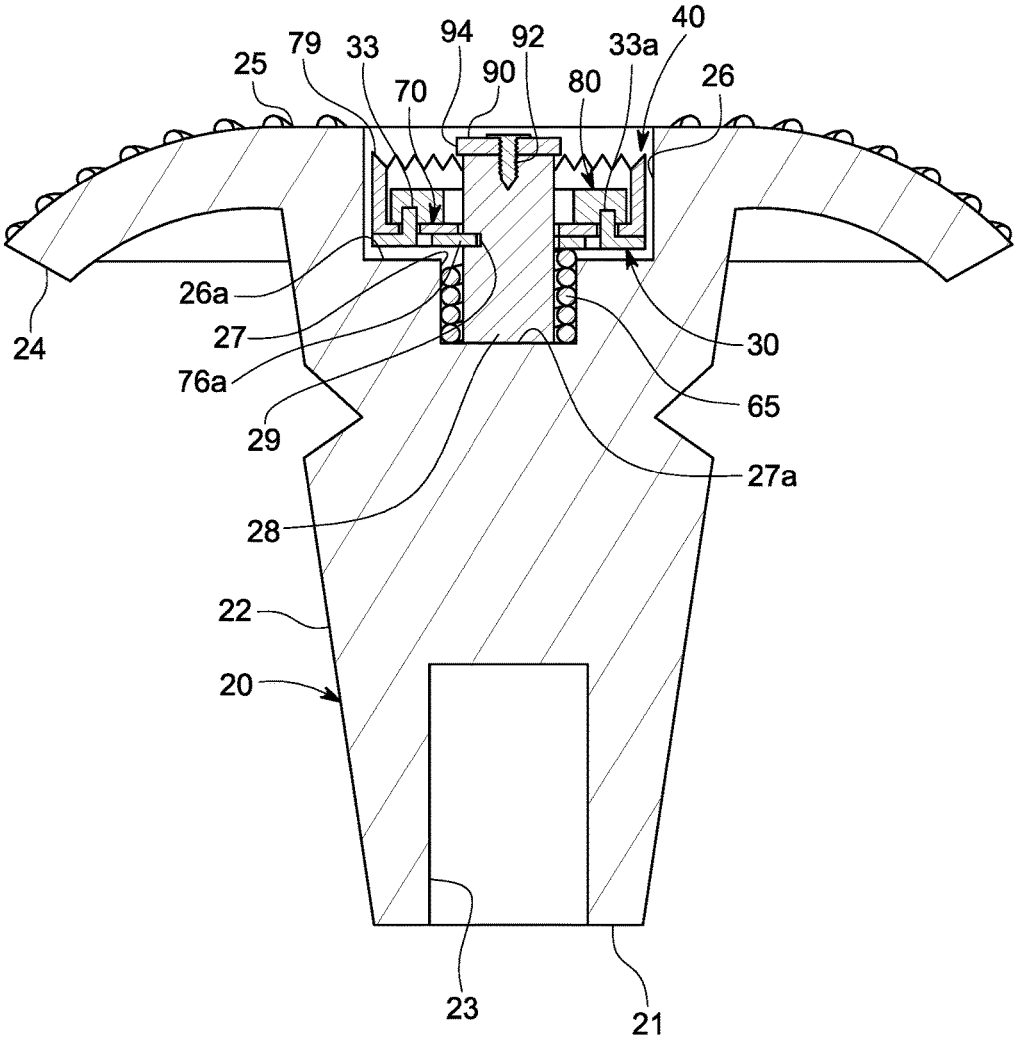
FIG. 1B is similar to the previous figure with spike mechanism 40 retracted with slotted locking plate 30 lodged inside cutout 29.
Figure 2:
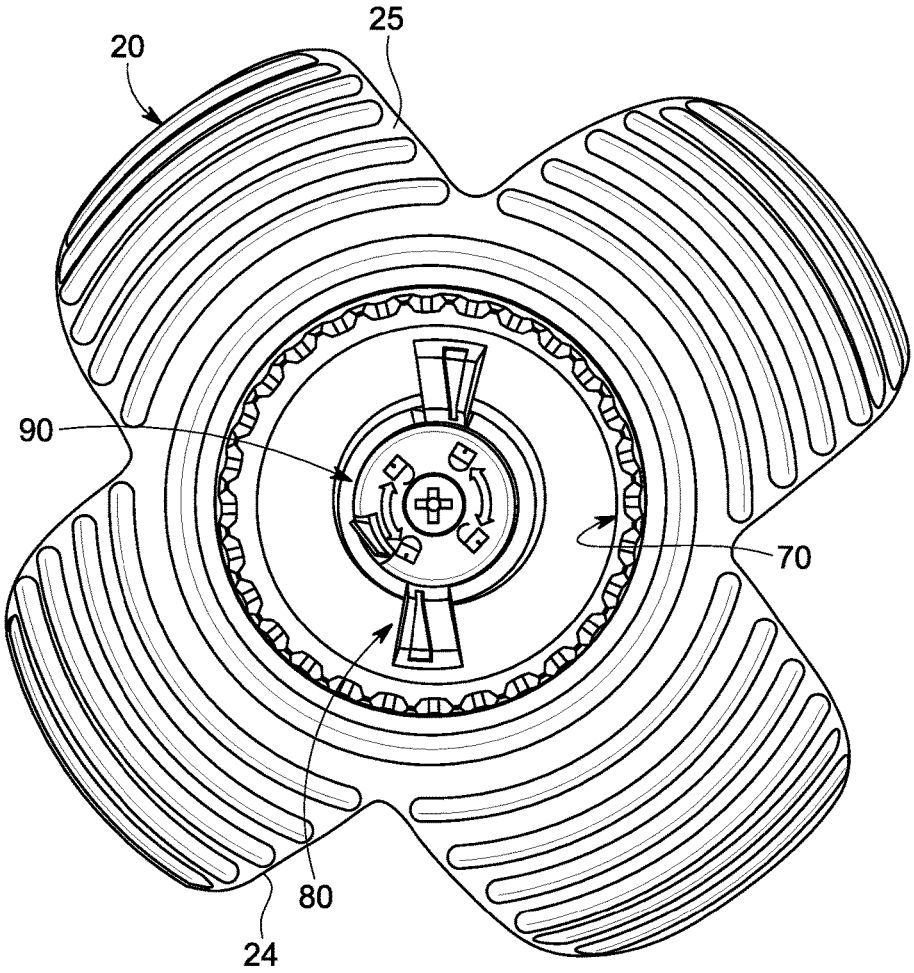
FIG. 2 shows a bottom view of the shoe shown in FIG. 1 with spike mechanism 40 retracted.
Figure 3:
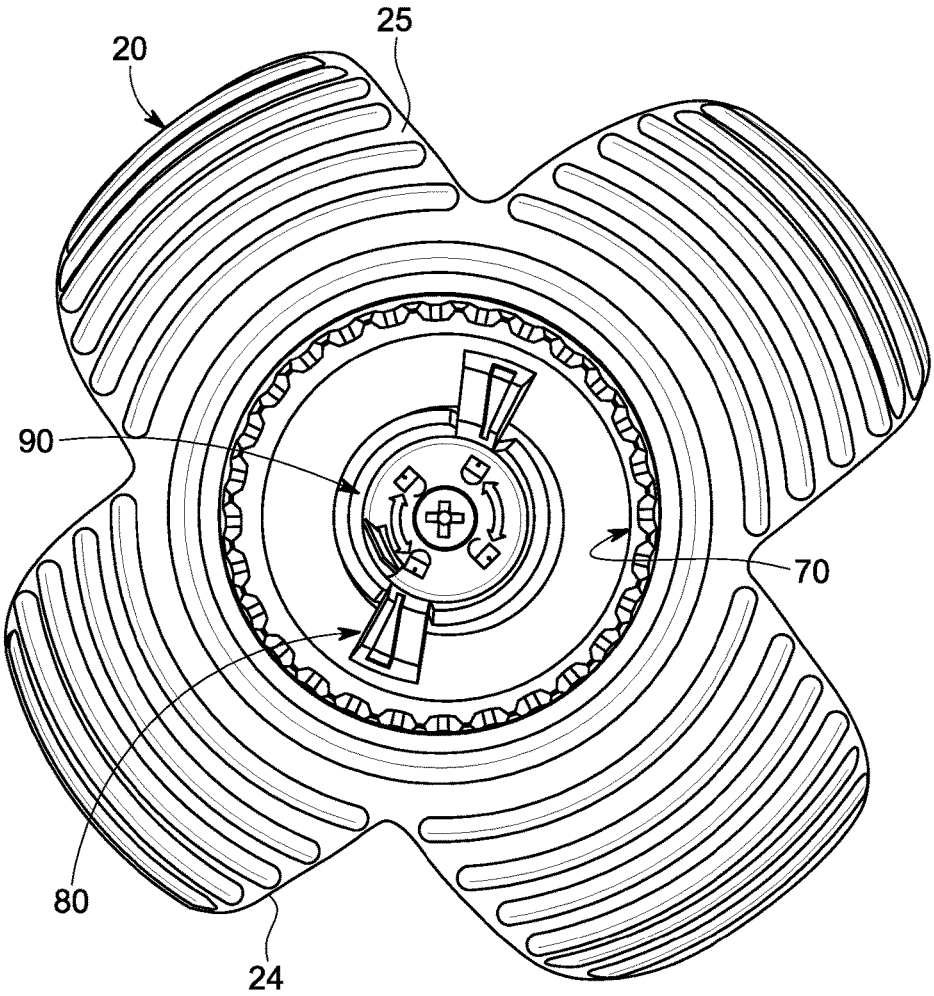
FIG. 3 illustrates the bottom view of the shoe represented in the previous figures with the spike mechanism 40 deployed.
Figure 4:
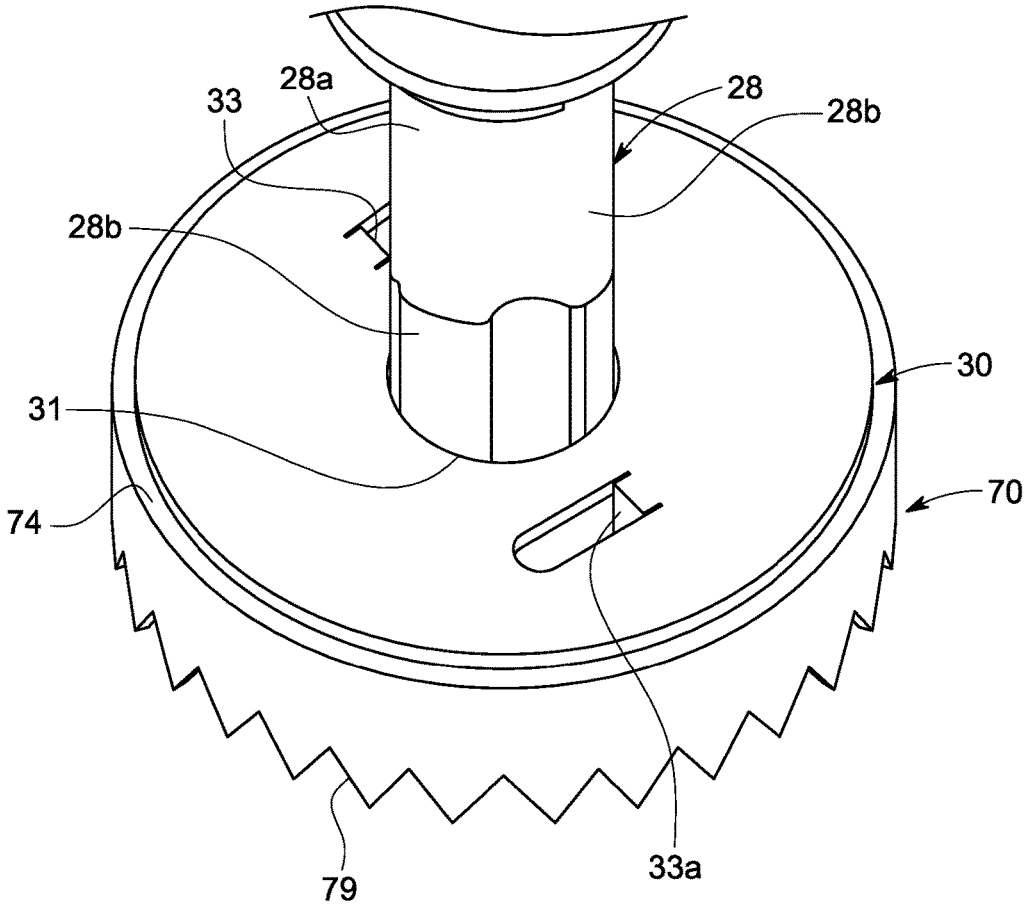
FIG. 4 is an inclined representation of teethed cap member 70.

Assembly 20 includes tubular member 22 and landing member 24 as seen in FIG. 1 with shaft S partially shown. Spike mechanism 40 is shown with protruding teethed cap member 70 and stopper screw assembly 90. Tubular member 22 includes a centrally disposed opening 23, as best seen in FIGS. 1A and 1B. Centrally disposed opening 23 snuggly receives shaft S. Starting from end 21, opening 23 extends axially a predetermined distance sufficient to provide a tight and snuggly engagement with one end of shaft S. End 25 is defined by the outer surface (preferably rugged) of landing member 24 and includes central bore 26 extending inwardly from end 25 a predetermined distance as best seen in FIGS. 1A and 1B. An additional smaller bore 27 extends, from bottom 26*a*, a predetermined distance to define bottom 27*a*. Post 28 extends axially upwardly from bottom 27*a* a predetermined distance. The diameter of bore 27 is larger than the diameter of post 28 so that coil spring member 65 can be received in between.

Post 28 has, in one of the embodiments, inner portion 28*a* and another portion 28*b*. Post 28 extends axially outwardly from bottom 27*a* a predetermined distance. Another portion 28*b* has an irregular, non-circular contour that permits the passing of similarly contoured plate and cap central keyed slots 31 and 76, respectively. Central keyed slots 31 and 76 have the same configuration with irregular inner edges 31*a* and 76*a* respectively. Post 28 includes cutout 29 that extends transversally a predetermined distance that is sufficient to permit the locking engagement of one of innermost portions 31*b* of irregular inner edge 31*a* of plate central keyed slot 31 when rotated with respect to cap central keyed slot 76, as seen in FIG. 1B. A user selectively rotates slotted locking plate 30 with knob 80, as discussed, below. The location of cutout 29 is at a cooperative distance from the distal end of post 28 to allow for the complete retraction of teethed cap member 70 within bore 26 in one configuration.

Figure 5:
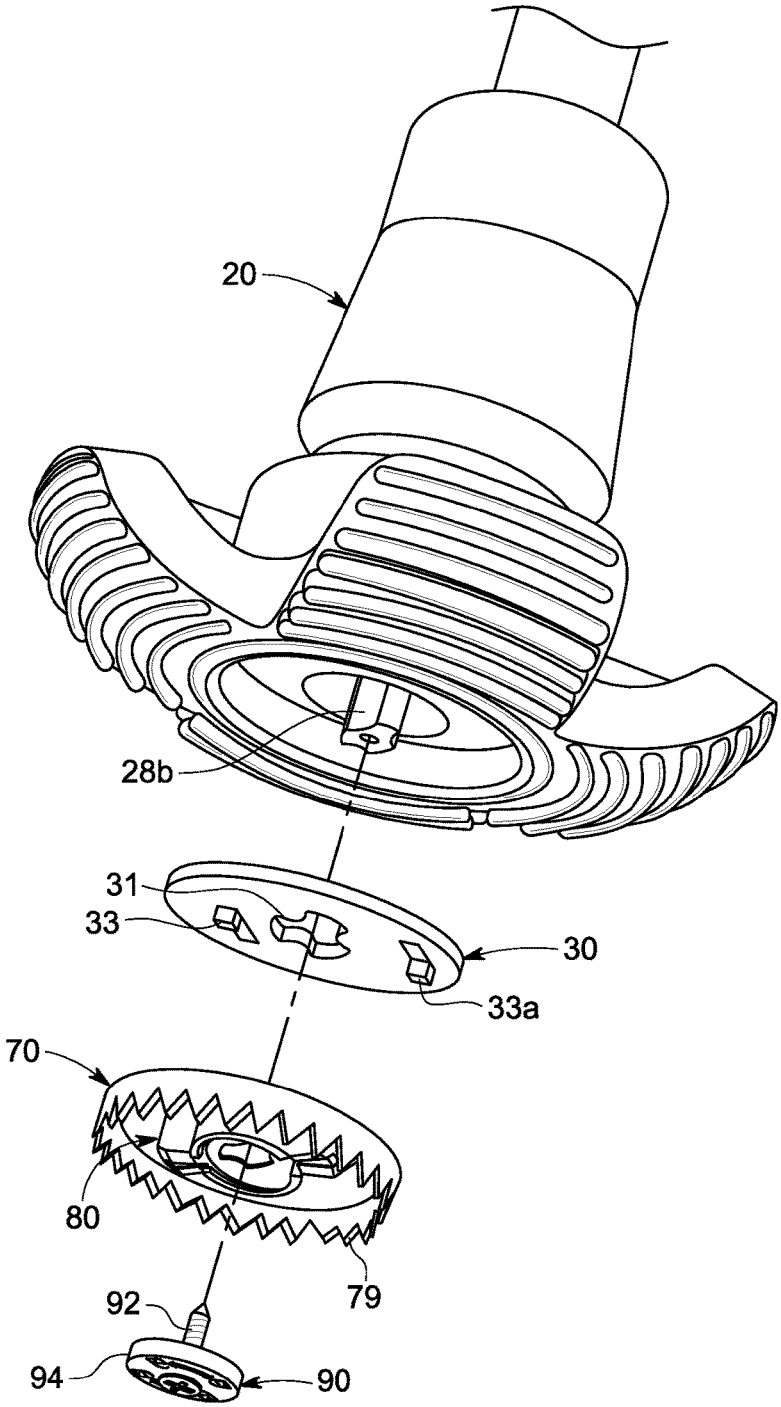
FIG. 5 is an exploded view showing the components of the shoe at an inclined angle from the bottom also showing spike mechanism 40 with knob assembly 80 ready to be pressure fitted to raised portions 33; 33*a*.
Figure 6:
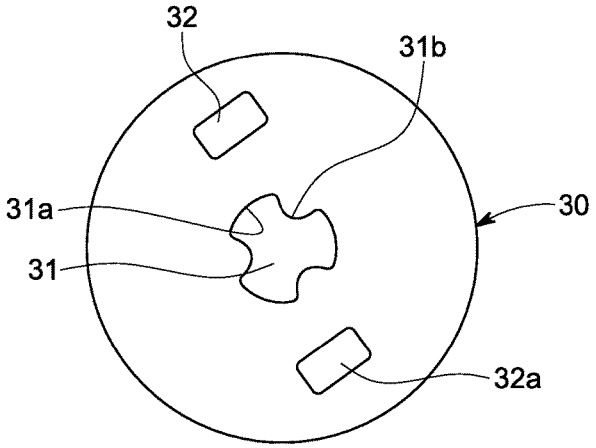
FIG. 6 shows a top view of slotted locking plate 30.
Figure 6A:
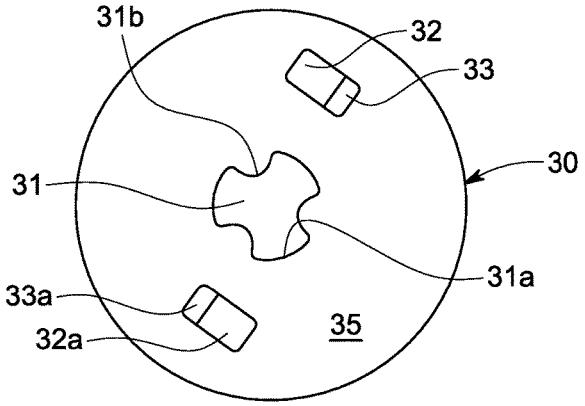
FIG. 6A shows a bottom view of slotted locking plate 30.

Spike mechanism 40 includes slotted locking plate 30 and teethed cap member 70, as seen in FIGS. 1A and 5. Slotted locking plate 30 includes central keyed slot 31, as best seen in FIGS. 6; 6A; 6B and 6C. Plate slots 32; 32*a* are positioned opposite to each other and include raised portions 33 and 33*a*, respectively. Top surface 35 coacts with the distal end of coil spring member 65.

Figure 6B:
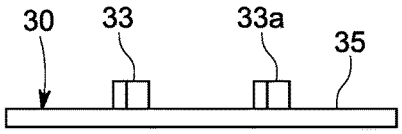
FIG. 6B is a side elevational view of slotted locking plate 30.
Figure 6C:
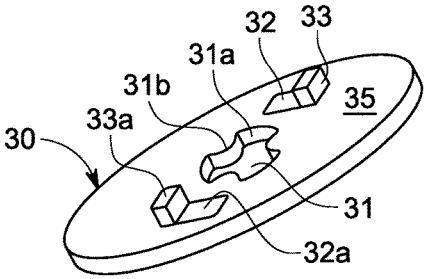
FIG. 6C is an inclined view of slotted locking plate 30.
Figure 7:
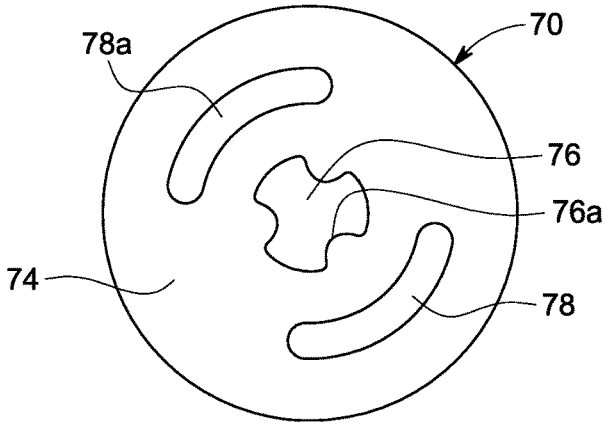
FIG. 7 shows a top view of teethed cap assembly 70.
Figure 7A:
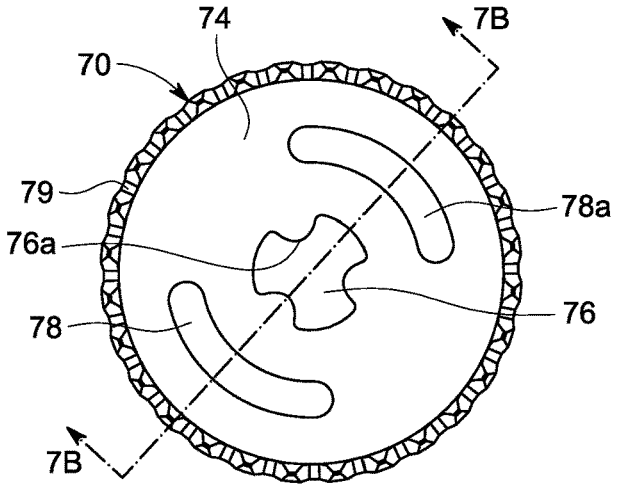
FIG. 7A shows a bottom view of teethed cap assembly 70.
Figure 7B:
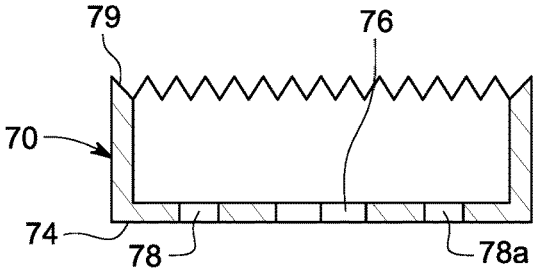
FIG. 7B shows a cross-sectional view of teethed cap assembly 70 taken along cutting line 7B-7B.
Figure 8:
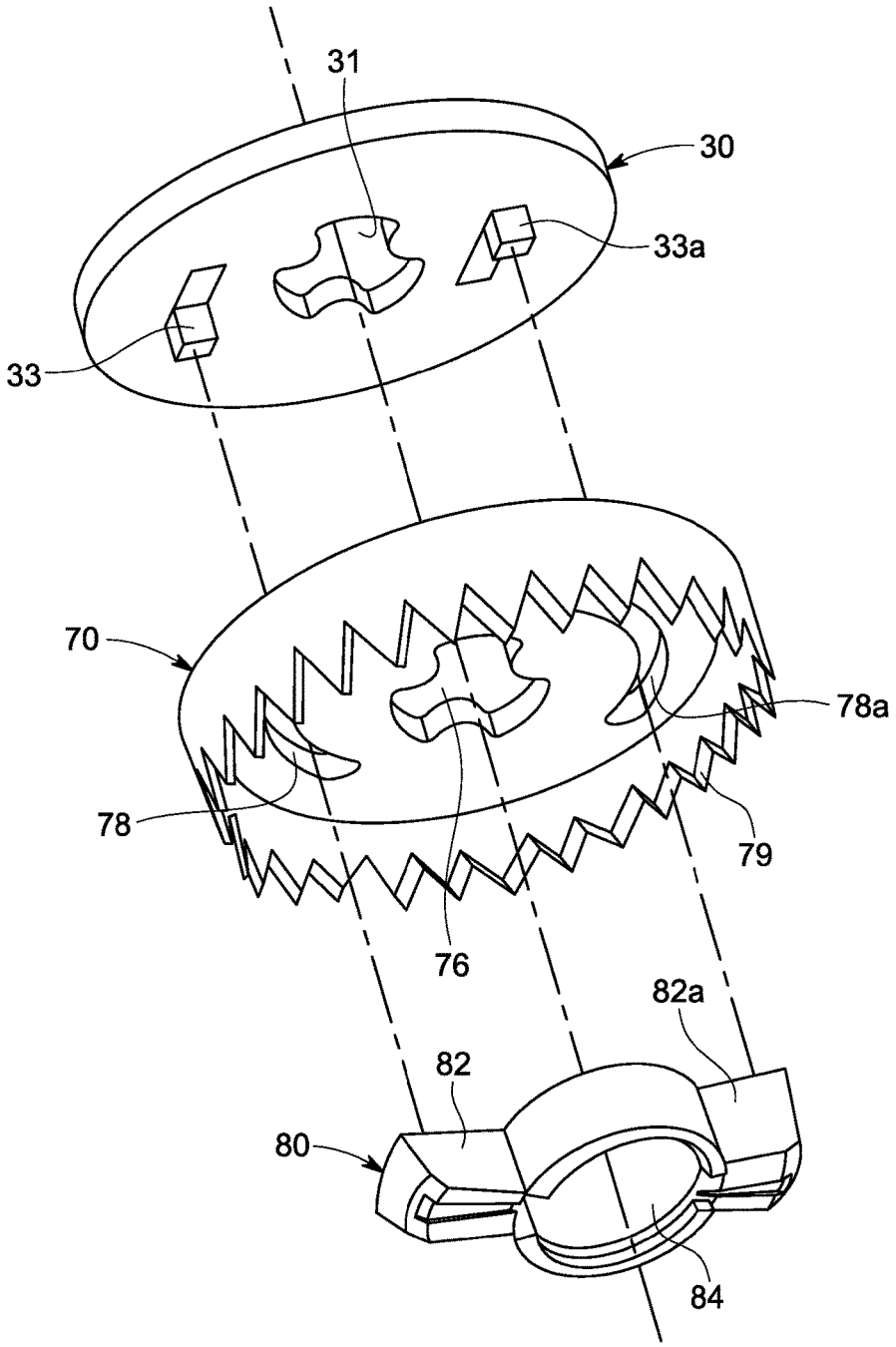
FIG. 8 is an exploded view showing slotted locking plate 30 with teethed assembly 70 and knob 80.
Figure 9:
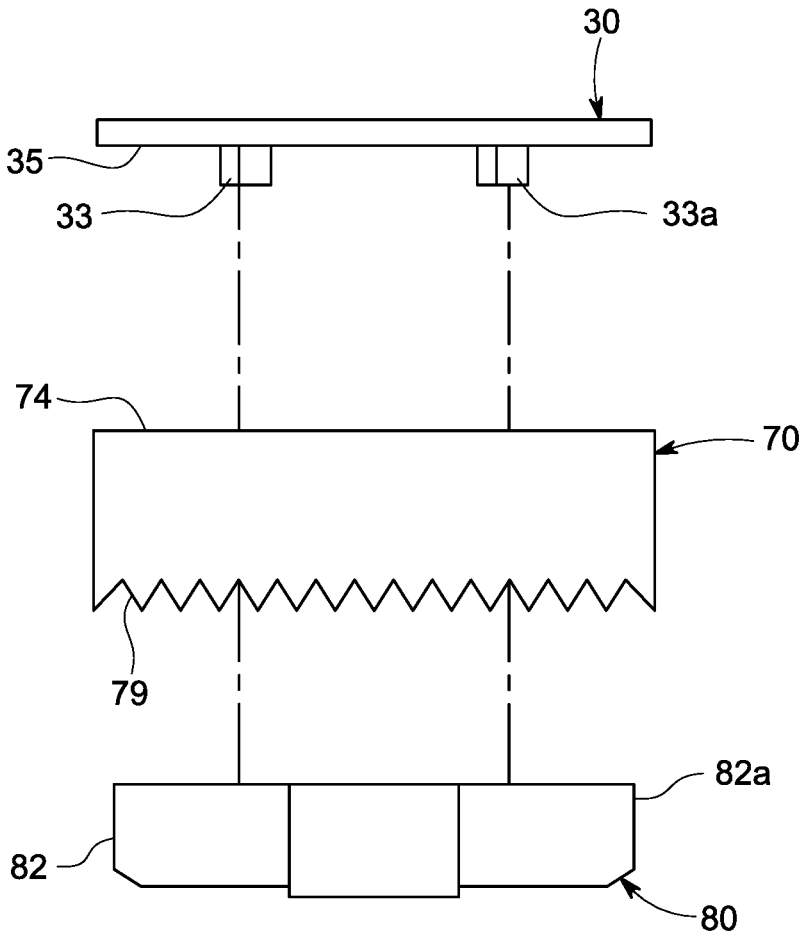
FIG. 9 shows a side view of teethed cap assembly 70.

Slotted locking plate 30 includes plate slots 32 and 32*a* and each with respective raised portions 33 and 33*a*, as best seen in FIGS. 6B and 6C. Raised portions 33; 33*a* pass through cap slots 78; 78*a* to engage knob ends 82; 82*a*.

One end of teethed cap member 70 has circular wall 74 with central keyed slot 76 and opposite cap slots 78 and 78*a*.

The other end of cap member 70 is open and edge 79 is teethed. Teethed edge 79 is designed to engage slippery icy surfaces.

A spring member 65 coacts with bottom surface 27*a* and with top surface 35 of slotted locking plate 30. Spring member 65 is biased to force locking plate 30 away from bottom surface 27*a*, as best seen in FIG. 1A.

Knob assembly 80 has knob ends 82; 82*a* and a circular central knob through hole 84 that allows post 28 to pass therethrough. Raised portions 33; 33*a* are firmly mounted to knob ends 82; 82*a* to permit the penetration inside knob ends 82; 82*a* which are preferably made of a resin or thermoplastic material. The result is that circular wall 74 is sandwiched between spring biased slotted locking plate 30 and assembly knob assembly 80. Rotating knob assembly 80 causes slotted locking plate 30 to rotate when edge 31*a* coincides with cutout 29. Plate central keyed slot 31 has the same non-circular configuration as cap central keyed slot 76. At certain relative rotated positions, slots 31 and 76 coincide and they correspond with the keyed configuration of post 28 when edge 31*a* coincides with cutout 29.

Screw assembly 90 includes screw member 92 and washer 94. Washer 94 has cooperative dimensions to fit inside through hole 84. Washer 94 is wider than central keyed slot 31 and central keyed slot 76 to prevent cap assembly 70 to travel beyond a predetermined distance and staying within a predetermined distance from the distal end of post 28.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe for canes and crutches comprising:

(A) a cylindrical tubular assembly having first and second ends, said first end mounted to the end of a shaft or crutch, said second end having a central first bore axially extending inwardly a first predetermined distance defining a first bottom and a coaxially disposed second bore having a smaller diameter than said first bore and extending inwardly from said first bottom a second predetermined distance defining a second bottom; and further including a post extending axially from said second bottom a third predetermined distance and said post further including an inner portion adjacent to said second bottom, and an outer portion extending to the distal end of said post said outer portion having an irregular contour;

(B) a circular locking plate housed within said first bore and having a diameter larger than said second bore and further having a central keyed slot having the same irregular contour of said outer portion to cooperatively slidably move along said outer portion, said circular locking plate including a pair of equal and opposite slots defined at a predetermined distance from the periphery of said circular locking plate, each slot having a raised portion; and (C) a coil spring member coaxially disposed around said post and external thereto, said spring member having first and second end, said first end coacting against said second bottom and said second end coacting against said circular locking plate to urge said circular locking plate away from said second bottom;

(D) a cap, with two ends, having a cylindrical shape with substantially the same diameter as said circular locking plate, one of said ends having a circular wall with a central keyed slot with an irregular edge contour that is similar to the irregular contour of said outer portion, and the other end of said cap being open and having a teethed edge, said circular wall further including two opposite curved slots that allow said raised portions to pass therethrough and move a predetermined distance along said curved slots;

(E) a knob having first and second knob ends, and further including a central through opening with cooperative dimensions to allow said outer portion of said post to pass therethrough, and said knob ends being mounted to said raised ends, respectively; and (F) a screw assembly including a screw member and a washer, said washer having cooperative dimension to be received with said central through opening of said knob and a central through hole having cooperative dimensions to coact with said circular locking plate to limit said circular locking plate's spring biased outwardly movement.

* * * * *